US005913631A

United States Patent [19]

Landry

[11] Patent Number: 5,913,631

[45] Date of Patent: Jun. 22, 1999

[54] COSMETIC APPLICATOR

[76] Inventor: Tina M. Landry, 121 LeBouef St., Montegut, La. 70377

[21] Appl. No.: 09/016,117

[22] Filed: Jan. 30, 1998

[51] Int. Cl.[6] ..... A46B 11/00

[52] U.S. Cl. ..... 401/127; 401/126; 401/129

[58] Field of Search ..... 401/127, 126, 401/128, 129, 130, 118

[56] References Cited

U.S. PATENT DOCUMENTS

| | | | |
|---|---|---|---|
| 68,163 | 8/1867 | Burnet | 401/127 |
| 5,086,793 | 2/1992 | Kingsford . | |
| 5,096,320 | 3/1992 | Norman et al. | 401/127 |
| 5,339,841 | 8/1994 | Gueret . | |
| 5,466,081 | 11/1995 | Schrepf . | |
| 5,556,214 | 9/1996 | Ascolese . | |
| 5,556,216 | 9/1996 | Mayesh | 401/127 |
| 5,595,198 | 1/1997 | Kemmerer . | |
| 5,620,270 | 4/1997 | Gueret . | |
| 5,690,441 | 11/1997 | McManus | 401/127 |

*Primary Examiner*—David J. Walczak
*Attorney, Agent, or Firm*—Kenneth L Tolar

[57] ABSTRACT

A cosmetic applicator for use with a standard cosmetic container includes a cylindrical cap having an open end around the inner periphery of which is a threaded portion for threadedly engaging a cosmetic container. An aperture is disposed on the opposing closed end for slidably receiving a button. An elongated stem protrudes from the cap having an applicator portion at a distal end. The opposing end of the stem has a conical stop member attached thereto which abuts the button. A second rubber stop member surrounds the stem and is proximal the cap open end for engaging a cosmetic container neck opening. On the upper surface of the second stop member is an annulus. Disposed between the annulus and the first stop member and surrounding the stem is a coil spring for biasing the stem upwardly when the button is depressed. Accordingly, the button may be depressed to selectively extend the applicator portion to the bottom of a cosmetic container allowing a user to access the cosmetic residue that is normally discarded.

5 Claims, 1 Drawing Sheet

COSMETIC APPLICATOR

BACKGROUND OF THE INVENTION

The present invention relates to an applicator for applying cosmetics such as mascara and nail polish, and more specifically, an applicator brush for threadedly engaging a cosmetic container having a spring biased stem which may be axially extended within the container so that the brush tip can contact the bottom surface thereof.

DESCRIPTION OF THE PRIOR ART

Mascara, nail polish and similar cosmetic products are typically applied using a container and an accompanying brush or wand component. The brush component typically comprises a cap with an elongated shaft extending therefrom with an applicator surface at a distal end of the shaft. The cap threadedly engages the container allowing the device to be stored with the shaft and applicator surface received therein. To allow the cap to be tightened completely against the container, the brush component is typically dimensioned such that the shaft and integral applicator portion are significantly shorter than the cosmetic container. When applying the cosmetic, a user dips the applicator portion into the tube to allow the cosmetic to adhere thereto. However, when the level of mascara remaining in the bottle diminishes below a predetermined level, the dimension of the brush component will not allow the applicator portion to contact the remaining cosmetic. Accordingly, the container must be tilted on its side which is burdensome and inconvenient. Tilting and manipulating the container can also result in external contamination of the cosmetic thereby increasing the risk of eye infections and similar health problems.

Numerous mascara, makeup and cosmetic applicator devices exist in the prior art. However, none relate to a simple, easy to use applicator according to the present invention. For example, U.S. Pat. No. 5,556,214 issued to Ascolese relates to a mascara case including a mascara storage vial and a cap having a T-shaped wand extending therefrom. The cap further includes a sealing ridge engaging the vial to form an air tight seal around the vial to prevent mascara therein from evaporating.

U.S. Pat. No. 5,466,081 issued to Schrepf discloses a cosmetic applicator comprising a cap with a stem and a brush projecting therefrom wherein the stem and the brush are ejectable from the cap allowing the cap to be used with a variety of brushes. An open ended retainer socket mounted in the cap receives and releasably engages the proximal end of the stem to secure the stem to the cap. A manually operable plunger is received within the cap for engaging the proximal end of the stem in the retainer socket to eject the stem therefrom.

U.S. Pat. No. 5,339,841 issued to Gueret relates to a make-up device having a cylindrical body for storing a make-up product and a nozzle thereon for dispensing a measured amount of the make-up product onto an applicator. The applicator is permanently mounted onto the cylindrical body and includes a shaft having an internal passage in communication with the nozzle.

U.S. Pat. No. 5,595,198 issued to Kemmerer relates to a mascara applicator comprising a central twisted wire core with a helical brush section on an end thereof, the bristles of which are disposed so as to form a helical groove therethrough. The device is designed to maximize the amount of mascara collected by the brush.

U.S. Pat. No. 5,620,270 issued to Gueret relates to a device for storing and applying a make-up product comprising a container and a first applicator received within a second applicator. The first applicator has a cap on an end thereof removably attached to the cap on the second applicator.

U.S. Pat. No. 5,086,793 issued to Kingsford relates to an adjustable mascara applicator having a pair of combs in which the spacing of the adjacent teeth may be adjusted and varied.

As indicated above, none of the prior art devices relate to a cosmetic applicator threadedly engaging a cosmetic container which may be selectively extended to the bottom of the bottle allowing the applicator portion to contact the cosmetic when it has diminished below a predetermined level. Accordingly, the applicator may be used to collect and apply the remaining cosmetic residue that is typically discarded along with the bottle.

SUMMARY OF THE INVENTION

The present invention overcomes the above enumerated problems by providing a cosmetic applicator for selectively engaging a standard nail polish bottle or a mascara tube. The device includes an elongated hollow cylindrical cap member having an open end. Adjacent the interior peripheral edge of the open end is a threaded portion for threadedly engaging a cosmetic container such as a mascara tube or nail polish bottle. Received within the cap and extending from its open end is an elongated stem having an applicator portion at a distal end thereof comprising bristles, cloth, sponge or similar material. Protruding from an aperture on the opposing end of the cap is a button. A substantially conical rubber stop member surrounds the stem and is proximal the open end of the cap for engaging the opening in a cosmetic container neck. On the upper surface of the rubber stop member is a plastic annulus. A similar rubber stop receives the end of the stem opposite the applicator portion and engages an end of the button. Disposed between the annulus and the opposing rubber stop is a coil spring for biasing the stem upwardly. Therefore, when the button is depressed, the stem will be displaced axially within the container against the bias of the spring allowing the brush to contact the remaining liquid on the bottom of the cosmetic bottle. When the button is released, the stem returns to its original position. It is therefore an object of the present invention to provide a cosmetic applicator that is vertically displacable within a cosmetic container.

It is yet another object of the present invention to provide a cosmetic applicator that allows a user to access and apply the entire contents of a cosmetic container.

It is yet another object of the present invention to provide a cosmetic applicator that prevents the cosmetic from being contaminated. Other objects, features and advantages of the present invention will become readily apparent from the following detailed description of the preferred embodiment when considered with attached drawings and the appended claims.

DESCRIPTION OF THE PREFERRED EMBODIMENT

Figure 3:
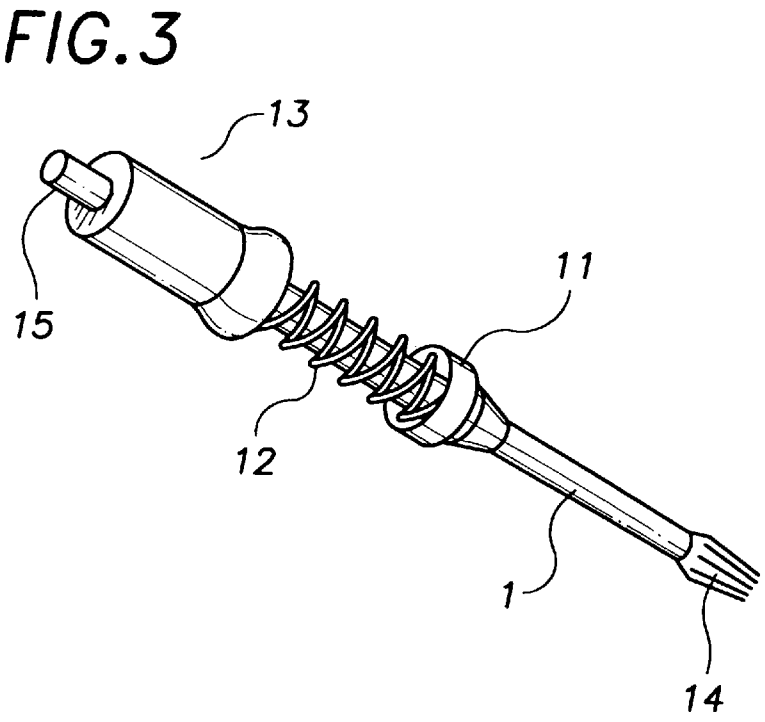
FIG. 3 depicts a second embodiment of the present invention relating to a nail polish applicator.
Figure 1:
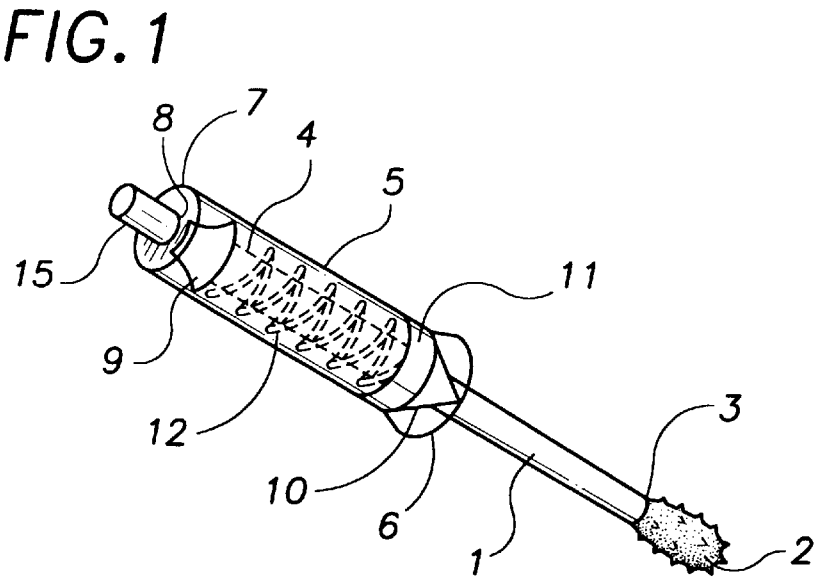
FIG. 1 depicts the inventive device.
Figure 2:
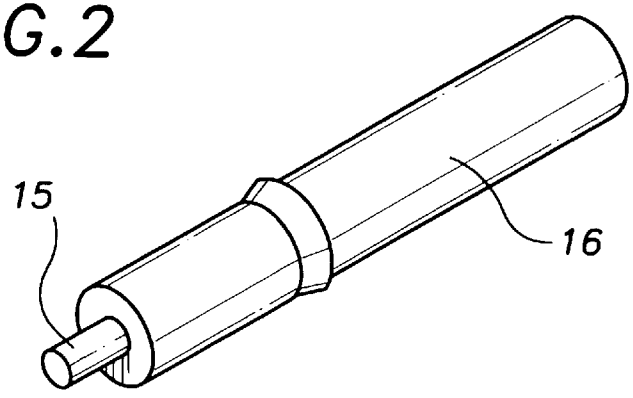
FIG. 2 depicts the inventive device attached to a mascara tube.

Referring now to FIGS. 1 through 3, the present invention relates to a cosmetic applicator attachable to a cosmetic container such as a mascara tube 16 or a nail polish bottle. The mascara tube or nail polish bottle is generally cylindrical and hollow having a threaded neck portion for threadedly receiving an applicator device or a cap and an opening in the neck portion in communication with an interior chamber. The present invention relates to a cosmetic applicator for attaching to one of the above described cosmetic containers.

FIGS. 1 through 2 depict a first embodiment of the present invention relating to a mascara applicator. The device includes an elongated stem 1 having first 3 and second ends 4 with an applicator portion 2 at a first end thereof. The applicator portion comprises a foam or cloth tip, rigid radially extending bristles or a similar material to which mascara will adhere. The second end is received within a substantially cylindrical, hollow cap member 5 having an open first end 6 and a second substantially closed opposing end 7 having an aperture thereon 8. Around the inner peripheral edge of the open end is a circumferential threaded portion (not pictured) for threadedly engaging the threaded portion on a mascara tube neck.

Received within the aperture on the second end is a movable button 15. Attached to the second end of the stem is a substantially conical, rubber stop 9 the vertex of which engages the button. A second similar stop member 10 receives the stem proximal the open end of the cap. The circular base portion of the second conical stop member 10 preferably has a slightly larger diameter than that of the opening in the neck portion of the cosmetic container thereby anchoring the stop when the cap is placed thereon. Resting on the upper surface of the second stop member is an annulus 11. Disposed between the annulus and the first rubber stop member 9 is a coil spring 12 surrounding the stem 1. A first end of the spring rests on the upper surface of the annulus with its second end engaging the first rubber stop member. Accordingly, when the button is depressed, the stem will be vertically displaced against the bias of spring 12.

A second embodiment according to the present invention is depicted in FIG. 3 and relates to a nail polish applicator 13. The applicator portion comprises a plurality of flexible bristles 14 extending axially from said stem and are similar to those found on a standard nail polish applicator. The second embodiment includes a cap member having a shorter length than the cap member in the first embodiment. The spring 12 at least partially extends from the cap member and surrounds the stem. Adjacent the upper and lower ends of the spring are stop members similar to that of the first embodiment, the lower stop member having a diameter larger than that of the bottle neck opening. Accordingly, when the cap member is threadedly coupled with a nail polish bottle, the spring member is compressed to bias the stem. Furthermore, each of the above described components are dimensioned such that the device is conveniently coupled to a nail polish bottle.

To use the above described device, the cylindrical cap 5 is threadedly coupled to a mascara tube, nail polish bottle or a similar cosmetic container and the applicator may be used to apply the cosmetic as with a conventional applicator. When the cosmetic within the container decreases to a predetermined level, the button 15 may be depressed causing the elongated stem 1 to be displaced vertically toward the bottom of the container. The spring 12, however, will be compressed against the annulus and second stop member 10 which is affixed within the container neck thereby biasing the stem upwardly. The applicator portion can then contact the remaining cosmetic at the bottom of the tube. When the user releases the button, the spring biased stem will return to its original position.

Preferably, the spring is manufactured from stainless steel and the stop members with rubber. The remaining components may be plastic or a similar durable but lightweight material. However, the materials of construction of the various components may vary without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a cosmetic container having a threaded neck portion with an opening thereon, said opening in communication with an interior chamber, a cosmetic applicator comprising:

a substantially cylindrical, hollow cap having a first open end for selectively coupling with the neck portion of a cosmetic container and an aperture on a second substantially closed end;

an elongated spring biased stem extending from the open end of said cap, said stem having a first and a second end with a cosmetic applicator portion at the first end thereof;

a button protruding from said aperture on said cap, said button in communication with the second end of said stem for axially displacing said stem within said container when said button is depressed;

a first stop member for receiving the second end of said stem, an opposing side of which engages said button;

a second stop member surrounding said stem proximal the open end of said cap having a diameter larger than the opening in said neck portion;

an annulus disposed on the upper side of said second stop member;

a coil spring surrounding said stem having two opposing ends, a first of which engages said annulus and a second of which engages said first stop member for biasing said stem when said button is depressed.

2. A cosmetic applicator according to claim 1 further comprising a threaded portion around the inner periphery of the cylindrical housing proximal its open end for threadedly engaging the threaded neck portion of a cosmetic container.

3. A cosmetic applicator according to claim 1 wherein said applicator portion comprises a plurality of rigid bristles radially extending from the first end of said stem for applying mascara.

4. A cosmetic applicator according to claim 1 wherein said applicator portion comprises a foam material.

5. A cosmetic applicator according to claim 1 wherein said applicator portion comprises a plurality of flexible bristles extending axially from the first end of said stem.

* * * * *